US005207476A

United States Patent [19]

Payne

[11] Patent Number: 5,207,476

[45] Date of Patent: May 4, 1993

[54] INFANT SEAT WITH LONGITUDINALLY-ORIENTED HANDLE

[75] Inventor: Timothy J. Payne, Santa Ana, Calif.

[73] Assignee: North States Industries, Inc., Minneapolis, Minn.

[21] Appl. No.: 947,096

[22] Filed: Sep. 17, 1992

Related U.S. Application Data

[63] Continuation of Ser. No. 830,762, Feb. 3, 1992, abandoned, which is a continuation of Ser. No. 714,339, Jun. 12, 1991, abandoned, which is a continuation of Ser. No. 426,406, Oct. 24, 1989, abandoned.

[51] Int. Cl.[5] ..... A47D 13/02

[52] U.S. Cl. ..... 297/183; 16/126; 297/377

[58] Field of Search ..... 297/183, 250, 377; 16/110 R, 126, 127; 206/278

[56] References Cited

U.S. PATENT DOCUMENTS

| | | | |
|---|---|---|---|
| 1,035,642 | 8/1912 | Rosse . | |
| 1,328,832 | 1/1920 | Hanrath . | |
| 1,557,263 | 10/1925 | Millen . | |
| 1,807,267 | 5/1931 | Winship | 206/278 X |
| 2,324,421 | 7/1943 | Oullette . | |
| 2,675,860 | 4/1954 | Schroeder . | |
| 3,409,325 | 11/1968 | Hamilton et al. . | |
| 3,804,459 | 4/1974 | Nose . | |
| 3,857,604 | 12/1974 | Scott . | |
| 4,194,601 | 3/1980 | Yellin . | |
| 4,324,430 | 4/1982 | Dumas, Jr. et al. | 297/250 |
| 4,371,206 | 2/1983 | Johnson, Jr. . | |
| 4,634,175 | 1/1987 | Wise . | |
| 4,688,850 | 8/1987 | Brownlie et al. . | |
| 4,711,490 | 12/1987 | Brand | 297/250 |
| 4,718,715 | 1/1988 | Ho | 297/250 X |
| 4,746,165 | 5/1988 | Sadan . | |

*Primary Examiner*—Peter R. Brown

*Attorney, Agent, or Firm*—Merchant, Gould, Smith, Edell, Welter & Schmidt

[57] ABSTRACT

An infant seat with an improved handle structure that may be positioned in various ways to provide multiple uses for the seat. The handle structure is bifurcated in the carrying portion, and includes a transverse member which acts as the carrying handle.

10 Claims, 1 Drawing Sheet

INFANT SEAT WITH LONGITUDINALLY-ORIENTED HANDLE

This is a continuation of application Ser. No. 07/830,762, filed Feb. 3, 1992, now abandoned, which is a continuation of Ser. No. 07/714,339, filed Jun. 12, 1991, now abandoned, which is a continuation of application Ser. No. 07/426,406, filed Oct. 24, 1989 now abandoned.

TECHNICAL FIELD OF THE INVENTION

This invention relates to infant seats and more particularly, to an improved handle for carrying an infant seat.

BACKGROUND OF THE INVENTION

In today's society, it is often and evermore necessary for parents to transport young infants. No longer are infants left at home, but rather, the parents tote them along wherever they go. To that end, infant seats have been designed which have carrying handles attached to the infant seat for ease in transporting the infant. Further, infant seats have been designed such that the handles may be pivotally locked so that the angle of the infant seat can be adjusted.

For example, U.S. Pat. No. 4,634,175 to Wise discloses a generally U-shaped handle pivotally mounted to the sides of an infant seat such that the handle is transverse to the longitudinal length of the infant seat. Similarly, U.S. Pat. No. 4,668,850 to Brownlie and U.S. Pat. No. 3,409,325 to Hamilton et al. disclose a carrying handle that is transverse to the infant seat.

In using these devices, the user's arm is often positioned such that the palm of the hand is facing forward or backward. As one can readily appreciate, this is an awkward position for carrying an infant. In particular, with that position of the hand, the arm is an unnatural position and can become easily fatigued. Further, while carrying a baby in an infant seat, it is necessary to keep the seat away from one's body so that the seat is not accidentally kicked or bumped. Accordingly, there must be some space between the infant seat and the user's body. This requires the user to further extend the arm from the body.

Thus, there is a need for a handle on an infant seat which will permit the user to carry the infant in a more natural position such that the palm of the hand is facing the body, for example, as with a suitcase or briefcase. Normally, when one carries a suitcase, the palm of the hand is facing the side of the body of the user. In that position, the arm is more relaxed and subject to less fatigue from carrying the infant.

While it is possible with known infant devices to carry them with the palm of the hand facing the body, it is awkward. With prior art devices, at least half of the length of the baby seat is between the user's hand and body. This requires that the arm is extended further from the body and thus, it is more difficult to carry the infant seat for a long period of time.

SUMMARY OF THE INVENTION

Accordingly, it is an object of the present invention to provide an infant seat with an improved handle.

In order to achieve the foregoing object, an apparatus according to the instant invention includes first and second leg portions, each of the leg portions having a terminating end which is adapted for pivotal attachment to an infant seat and an opposing end, each of the opposing ends being bifurcated into a first support portion and a second support portion. A first bar member is connected to the first support portion of the first leg at a first end and to the first support portion of the second leg at a second end. A second bar member is connected to the second support portion of the first leg at a first end and to the second support portion of the second leg at a second end. A handle means for connecting the first bar to the second bar extends in a direction which is substantially perpendicular to directions in which the first and second bars extend.

These and various other advantages and features of novelty which characterize the invention are pointed out with particularity in the claims annexed hereto and forming a part hereof. However, for a better understanding of the invention, its advantages, and the objects obtained by its use, reference should be made to the accompanying descriptive matter, in which there is illustrated and described a preferred embodiment of the invention.

DETAILED DESCRIPTION OF THE PREFERRED EMBODIMENTS

Figure 1:
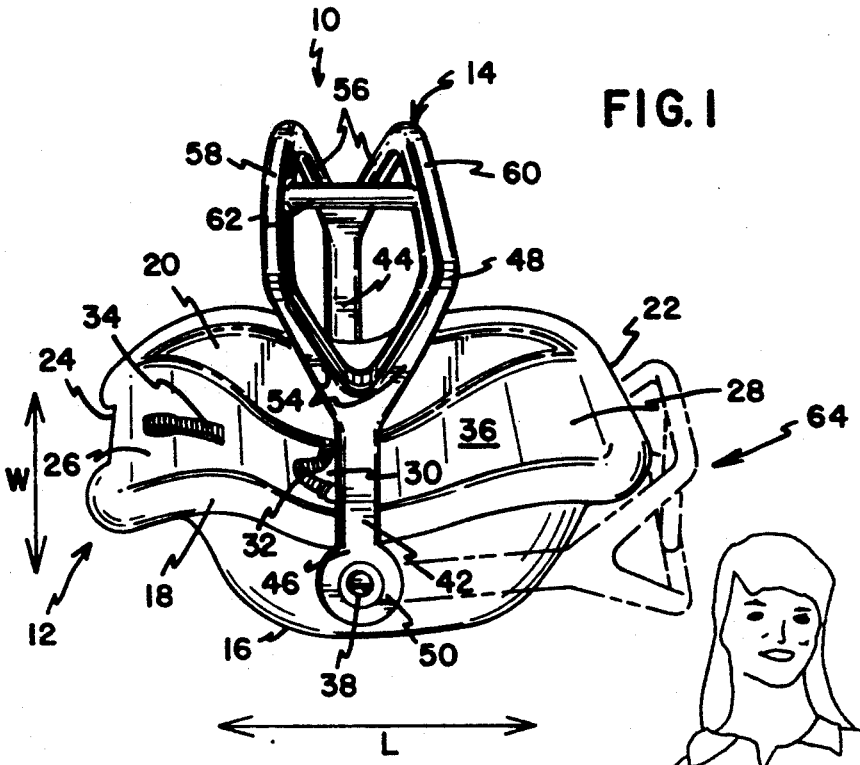
FIG. 1 is a perspective view of an infant seat which is constructed according to a preferred embodiment of the invention.

In referring to the figures, like parts are indicated by the same reference numerals in the different views.

Figure 2:
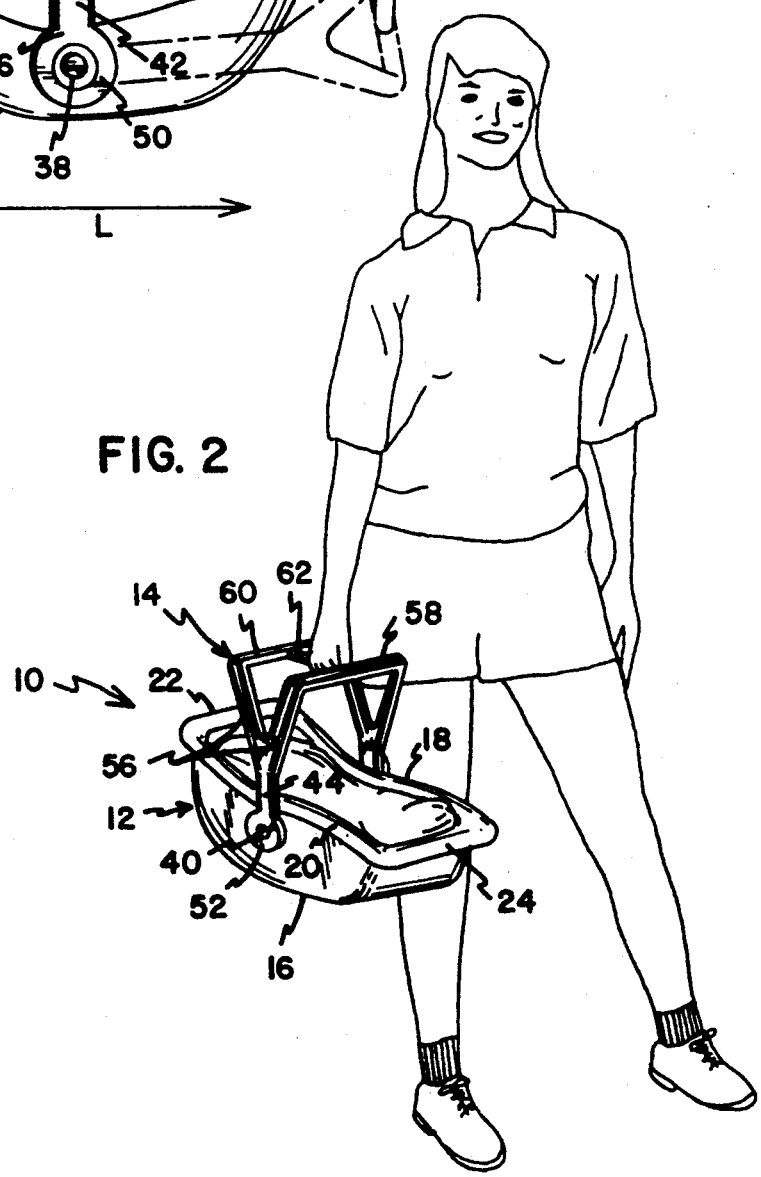
FIG. 2 is an optional view of the infant seat, shown in FIG. 1, in its surrounding environment.

Referring to FIGS. 1 and 2, the present invention an infant seat 10 according to a preferred embodiment of the invention comprises a shell 12 and a support member 14 pivotally mounted to the shell 12. The shell 12 is preferably a unitary, plastic molded member having a smooth, convexly curved underbelly 16, a pair of opposed substantially identical side walls 18 and 20, which extend transversely to the underbelly 16 of the shell 12, a top wall 22 and a bottom wall 24. The curved underbelly 16 allows the infant seat 10 to be used as a rocker. The shell 12 has a seat portion 26 and an elongated back portion 28, which form a single contoured wall 30.

The shell 12 is adapted for receiving a human baby (not shown) in a reclining position and has a length L and width W. Preferably, the shell 12 is sized and shaped such that the length L is greater than the width W.

The interior of the shell 12 is preferably provided with a waist strap 32 and a crotch strap 34, made for example of nylon webbing, and secured by a buckle (not shown) to prevent the baby from falling out of the infant seat 10. A soft resilient liner 36 covers the contoured wall 30 of the shell 12. The liner 36 is sized and shaped to fit over the surface of the contoured wall 30 and includes a foam pad covered by a water-resistant material.

On the opposing sides of the infant seat 10, there are pivot joints 38 and 40 for pivotally locking the support structure 14 onto the shell 12 in any one of a plurality of positions. There are many types of pivot joints well known in the art. In the present invention, pivot joints 38 and 40 are identical. Accordingly, description of pivot joint 38 will suffice. Pivot joint 38 includes a locking ring and a button spaced from the shell 12 by a spring (not shown). The interior of the locking ring has geared teeth. When the button is depressed toward the shell 12, the geared teeth are disengaged such that the handle support structure 14 may pivot into one of a plurality of positions. These pivot joints 38 and 40 can be locked in several orientations to facilitate different uses of the seat 10. For example, the support structure 14 can be locked in a first position to maintain the shell 12 of the infant seat 10 at an angle for feeding or playing (not shown), or in a second position such that the seat 10 could be used as a rocker (not shown), or in a third position to carry the infant seat 10 (FIGS. 1 and 2).

Support member 14 is generally U-shaped and is pivotally connected to the shell 12 for supporting the shell 12 in a plurality of adjustment positions on a supporting surface and for carrying the seat 10 from one location to another. The support structure 14 has a length such that it can be swung over at least one end of the shell 12. Thus, the support structure 14 can move between a carrying position as illustrated in solid lines in FIG. 1 in which it projects upwardly from the shell 12 and a plurality of chair-supporting positions in which it is disposed generally rearwardly of the shell 12. An example of a support position is illustrated in phantom lines at 64 in FIG. 1.

The support member 14 generally lies in a axis transverse to the shell 12. The support member 14, which is preferably formed as a plastic molding, includes a spaced parallel first and second leg portions 42 and 44 having terminating ends 46 and opposing ends 48. The leg portions 42 and 44 are respectively pivotally connected at their terminating ends 46 by pivot joints 38 and 40 to the exterior of opposing sides 18 and 20 of the shell 12. The pivot joints 38 and 40 are located in hub members 50 and 52 which extend from the terminating ends 46 of each leg portion 42 and 44. The leg portions 42 and 44 each bifurcate at their opposing ends 48 into outwardly angled first and second handle support portions 54 and 56. The handle support portions 54 and 56 are generally parallel to the opposing side 18 or 20 of the shell 12 to which the respective leg portion 42 or 44 is connected. Thus, each leg 42 and 44 portion and its corresponding handle support portions 54 and 56 form a generally "Y" shaped structure.

The handle support portions 54 and 56 of each leg 42 and 44 are connected by first and second bar members 58 and 60, each bar having a first end 62 and a second end 64. The first end 62 of the first bar 58 is connected to the first handle support portion 54 of the first leg 42 while the second end 64 is connected to the first handle support portion 54 of the second leg 44. Similarly, the second bar 60 is connected at its first end 62 to the second handle support portion 56 of the first leg 42 and at its second end 64 to the second handle support portion 56 of the second leg 44.

The bars 58 and 60 are generally perpendicular to the legs 42 and 44 and are located such that the legs are substantially in the center of the space between the bars 58 and 60. Thus, the parallel bars 58 and 60 extend between each of the opposing sides 18 and 20 of the shell 12.

Extending perpendicularly between the parallel bars 58 and 60 is a handle 66. The handle 66 is positioned longitudinally to the shell 12 and is generally located at the mid point of the bars 58 and 60 such that one half of the width of the shell 12 is located on each side of the handle 66. Preferably, the handle 66 is sized and shaped to receive a human hand of an adult user.

In operation, the user carries the infant seat 10 by grasping the handle 66. This allows the palm of the user's hands to face its body in a more natural position. Further, while the hand is in this position, the infant seat 10 does not have to be extended as far away from the body because the distance is only half the width of the infant seat as opposed to half the length of the seat which is required in prior art devices. The position of the handle 66 enables the user to carry the infant seat 10 like a suitcase or briefcase.

While many materials may be used, both the shell 12 and the support member 14 may be formed from a plastic resin. In particular, the support member 14 can be molded into one unitary piece of plastic. This enables the support member to be stronger.

What is claimed is:

1. An apparatus for use in carrying an infant seat or the like, comprising:

a) first and second leg portions, each of said leg portions having a terminating end which is adapted for pivotal attachment to an infant seat and an opposing end, each of said opposing ends being bifurcated into a first support portion and a second support portion;

b) a first bar member connected to said first support portion of said first leg at a first end and to said first support portion of said second leg at a second end;

c) a second bar member connected to said second support portion of said first leg at a first end and to said second support portion of said second leg at a second end; and d) handle means for connecting said first bar to said second bar, said handle means extending in a direction which is substantially perpendicular to directions in which said first and second bars extend.

2. Apparatus according to claim 1 wherein said apparatus is rotatable between a first carrying position and a second support position.

3. Apparatus according to claim 1 wherein said apparatus has a length such that it can by swung over at least one end of the infant seat.

4. Apparatus according to claim 1 wherein said apparatus is formed of plastic.

5. Apparatus according to claim 1 further including means for pivoting, said pivoting means extending from said terminating ends of said leg portions.

6. Apparatus according to claim 1 wherein each of said leg portions and respective first and second support portions generally define a "Y" shaped structure.

7. Apparatus according to claim 1 wherein said handle means is generally located at the midpoints of said first and second bars such that approximately one half of the width of the infant seat is located on each side of the handle means.

8. Apparatus according to claims 1 wherein said handle means is sized and shaped to receive an adult human hand.

9. An apparatus for carrying an infant comprising:

a) a shell sized and shaped to receive a human infant, said shell having a width and a length, said length generally longer than said width;

b) first and second leg portions, each of said leg portions having a terminating end which is adapted for pivotal attachment to the shell and an opposing end, each of said opposing ends being bifurcated into a first support portion and a second support portion;

c) a first bar member connected to said first support portion of said first leg at a first end and to said first support portion of said second leg at a second end;

d) a second bar member connected to said second support portion of said first leg at a first end and to said second support portion of said second leg at a second end; and e) handle means for connecting said first bar to said second bar, said handle means extending in a direction which is substantially perpendicular to directions in which said first and second bars extend.

10. An infant seat comprising:

a) a shell sized and shaped to receive a human infant, said shell having a width and a length, said length generally longer than said width;

b) means for carrying said infant seat, said carrying means being substantially rigid and positioned parallel to said length of said shell; wherein said carrying means comprises:

c) first and second leg portions, each of said leg portions having a terminating end which is adapted for pivotal attachment to an infant seat and an opposing end, each of said opposing ends being bifurcated into a first support portion and a second support portion;

d) a first bar member connected to said first support portion of said first leg at a first end and to said first support portion of said second leg at a second end;

e) a second bar member connected to said second support portion of said first leg at a first end and to said second support portion of said second leg at a second end;

f) handle means for connecting said first bar to said second bar, said handle means extending in a direction which is substantially perpendicular to directions in which said first and second bars extend; and g) means for mounting said carrying means to said shell.

* * * * *